US010540854B2

(12) United States Patent
Surmacz et al.

(10) Patent No.: US 10,540,854 B2
(45) Date of Patent: Jan. 21, 2020

(54) COMMUNITY GAME SERVER

(71) Applicant: Casino Game Maker, Inc., Las Vegas, NV (US)

(72) Inventors: Andrzej Surmacz, Las Vegas, NV (US); Darin T. Gifford, Cedar City, UT (US); Cason J. Adams, Cedar City, UT (US)

(73) Assignee: Casino Game Maker, Inc., Las Vegas, NV (US)

( * ) Notice: Subject to any disclaimer, the term of this patent is extended or adjusted under 35 U.S.C. 154(b) by 79 days.

(21) Appl. No.: 14/937,137

(22) Filed: Nov. 10, 2015

(65) Prior Publication Data

US 2017/0132869 A1 May 11, 2017

(51) Int. Cl.
*G07F 17/32* (2006.01)

(52) U.S. Cl.
CPC ..... *G07F 17/329* (2013.01); *G07F 17/32* (2013.01); *G07F 17/3244* (2013.01); *G07F 17/3272* (2013.01)

(58) Field of Classification Search
CPC . G07F 17/3244; G07F 17/3272; G07F 17/329
See application file for complete search history.

(56) References Cited

U.S. PATENT DOCUMENTS 7,819,742 B2 * 10/2010 Chamberlain ..... G06Q 20/10 463/16
8,016,655 B2 * 9/2011 Sato ..... G07F 17/32 463/11
9,292,996 B2 * 3/2016 Davis ..... G07F 17/32
9,600,971 B2 * 3/2017 Pececnik ..... G07F 17/3272
2006/0073882 A1 * 4/2006 Rozkin ..... G07F 17/32 463/25
2006/0135240 A1 * 6/2006 Barshack ..... A63F 3/00157 463/13
2006/0213977 A1 * 9/2006 Carnation ..... G06Q 20/10 235/380
2008/0054561 A1 * 3/2008 Canterbury ..... G07F 17/32 273/148 B
2008/0058048 A1 * 3/2008 Lutnick ..... G07F 17/3232 463/16
2008/0102916 A1 * 5/2008 Kovacs ..... G07F 17/3211 463/16
2008/0113783 A1 * 5/2008 Czyzewski ..... A63F 3/00157 463/29
2008/0149705 A1 * 6/2008 Giobbi ..... G06F 21/35 235/376

(Continued)

*Primary Examiner* — Xuan M Thai
*Assistant Examiner* — Malina D. Blaise
(74) *Attorney, Agent, or Firm* — Kwan & Olynick LLP

(57) ABSTRACT

An apparatus is provided. The apparatus includes a random number generator that randomly selects a set of game indicia for a game of chance. Further, the apparatus includes a database that stores the set of game indicia. In addition, the apparatus includes a processor that retrieves the set of game indicia from the database, sends the set of game indicia to a game terminal to determine an outcome of the game of chance played by a first player, receives game data from the game terminal based on the outcome, and generates leader board data based upon the game data that is utilized by a second player to perform back betting.

20 Claims, 7 Drawing Sheets

(56) References Cited

U.S. PATENT DOCUMENTS

| | | | | |
|---|---|---|---|---|
| 2008/0180250 | A1* | 7/2008 | Steil | A63F 3/00157 340/572.1 |
| 2008/0227539 | A1* | 9/2008 | Sato | G07F 17/32 463/27 |
| 2008/0305855 | A1* | 12/2008 | Czyzewski | G07F 17/32 463/25 |
| 2009/0115133 | A1* | 5/2009 | Kelly | G07F 17/32 273/274 |
| 2009/0325686 | A1* | 12/2009 | Davis | G07F 17/32 463/25 |
| 2011/0009181 | A1* | 1/2011 | Speer, II | G07F 17/32 463/20 |
| 2014/0094239 | A1* | 4/2014 | Grauzer | A63F 1/12 463/13 |
| 2014/0274253 | A1* | 9/2014 | Chun | G07F 17/3225 463/11 |
| 2014/0274320 | A1* | 9/2014 | Nguyen | G07F 17/3225 463/25 |
| 2015/0119127 | A1* | 4/2015 | Arnone | G07F 17/3244 463/17 |
| 2015/0119131 | A1* | 4/2015 | Pececnik | G07F 17/3272 463/25 |
| 2017/0024975 | A1* | 1/2017 | Chun | G07F 17/42 |

* cited by examiner

| Player Name | Game | Score | Accuracy | Amount Wagered |
|---|---|---|---|---|
| Player 1 | Game A | 5,000 | 65% | $2,000 |
| Player 2 | Game A | 4,000 | 60% | $1,400 |
| Player 3 | Game B | 4,500 | 62% | $800 |
| Player 4 | Game B | 3,000 | 61% | $600 |
| Player 5 | Game B | 2,000 | 61% | $400 |

COMMUNITY GAME SERVER

BACKGROUND

1. Field

This disclosure generally relates to the field of gaming. More particularly, the disclosure relates to gaming devices utilized to operate games of chance.

2. General Background

Casinos typically provide a variety of games of chance that may be played by players. Some of those games of chance, e.g., Baccarat, typically derive a significant portion of associated revenue from players that are not active participants, but rather followers of other players that are deemed by such followers to be successful game participants. Such approach is referred to as back betting. The back betters or hoppers monitor active participants that are successfully playing a particular game of chance and then utilize the same game selections as those active participants. For example, the active participants may be seated at a game table in a casino. The back betters may then be standing or sitting behind such players to monitor the game selections of those players. Further, the back betters may regularly move from table to table in the casino to find the successful players.

Although such form of wagering is popular, the implementation is often chaotic and inefficient. For example, back betters typically have to find their way to various tables through crowds of other back betters. Further, the crowds of back betters often prevent other back betters from fully monitoring the game play of an active game participant.

As a result, some back betters, i.e., the back betters that get to a table before other back betters, often have an advantage. Such an advantage limits the potential participation of other casino customers as back betters, who may be discouraged from participating in back betting given that some back betters are able to obtain an advantage over other back betters merely by getting to one table from another faster than other back betters.

SUMMARY

In one aspect of the disclosure, an apparatus is provided. The apparatus includes a random number generator that randomly selects a set of game indicia for a game of chance. Further, the apparatus includes a database that stores the set of game indicia. In addition, the apparatus includes a processor that retrieves the set of game indicia from the database, sends the set of game indicia to a game terminal to determine an outcome of the game of chance played by a first player, receives game data from the game terminal based on the outcome, and generates leader board data based upon the game data that is utilized by a second player to perform back betting.

In another aspect of the disclosure, an apparatus is provided. The apparatus includes an input device that receives, from a first player, selection of a game of chance for game play and a wager amount. Further, the apparatus includes a processor that sends the wager amount to a game server, receives a randomly selected outcome from the game server, and receives leader board data based upon the game data that is utilized by a second player to perform back betting.

In another aspect of the disclosure, an apparatus is provided. The apparatus includes an input device that receives, from a first player, selection of a game of skill for game play and a wager amount. Further, the apparatus includes a processor that sends the wager amount to a game server, receives a randomly selected outcome from the game server, and receives leader board data based upon the game data that is utilized by a second player to perform back betting.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

DETAILED DESCRIPTION

A community game apparatus is provided to enable participation of multiple players in a single wagering event. The single wagering event may be a game of chance such as Baccarat, but is not limited to Baccarat. A game of chance is typically provided on a casino floor. The game of chance may be a casino game, lottery game, bingo game, etc. A game of chance will typically be operated with a random number generator or a manual random determination of an outcome. The game of chance may be a Class II or a Class III game. If the game of chance is a bingo game, the game of chance may or may not be limited to a finite quantity of bingo cards. Further, a casino network is typically utilized for operation of the game of chance. In another aspect of the disclosure, the casino game is played upon receipt of a wager corresponding to an outcome of the game of chance.

Alternatively, the single wagering event may be a game of skill rather than a game of chance. The game of skill may be a game that is based on an outcome other than that of a game of chance.

The community game apparatus allows a first player of the wagering event to place wagers on a game played by a second player. The community game apparatus allows the first player and the second player to gather data and place wagers through a networked configuration. The first player may select the second player or multiple players from a plurality of players that are playing the game. In other words, the back betting player may back bet on any number of players that participate in playing the game that is available for back betting. Therefore, back betting is not limited to only one second player as a multitude of players may be described as a second player.

Figure 1:
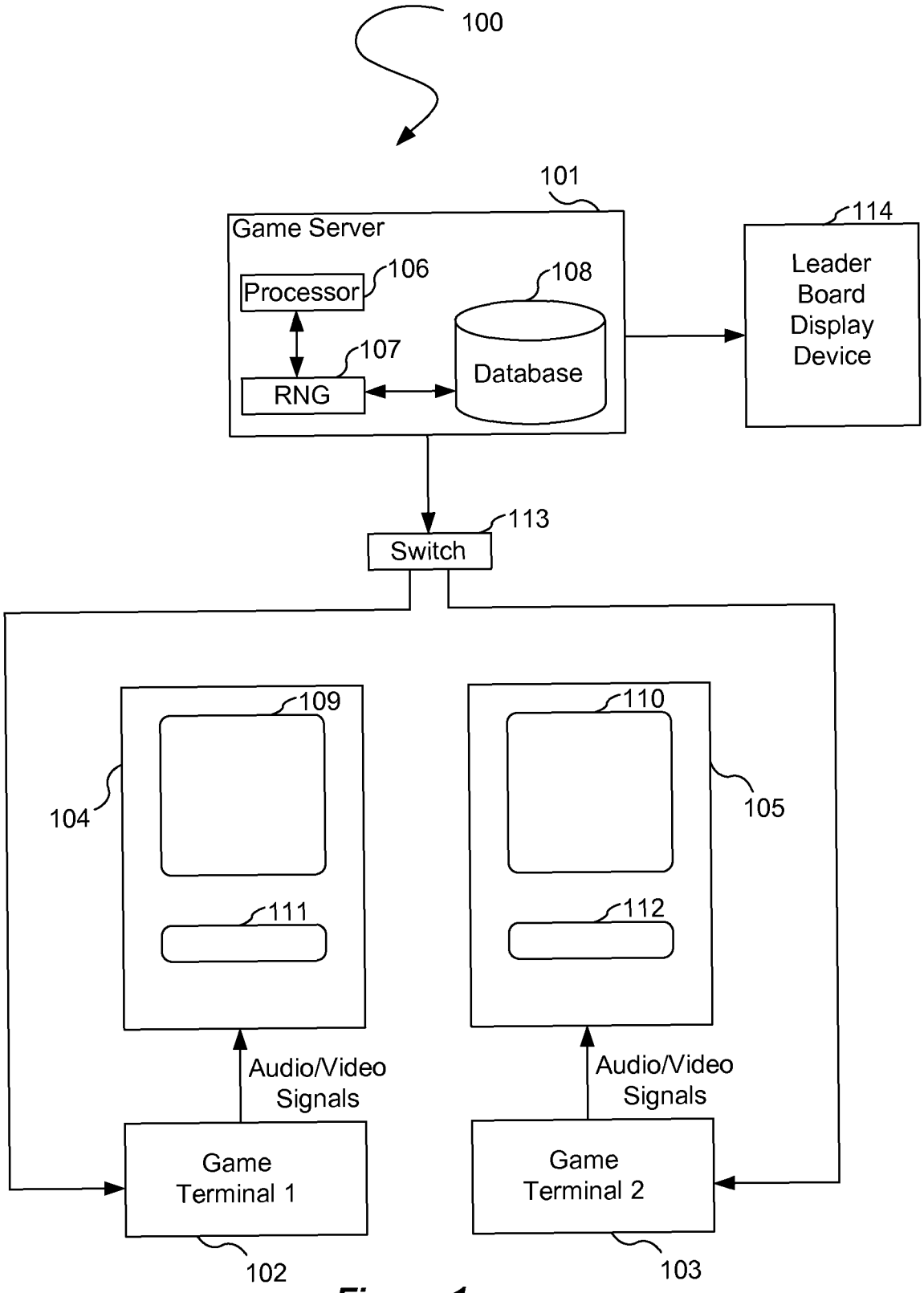
FIG. 1 illustrates a community game configuration.

FIG. 1 illustrates a community game configuration 100. The community game configuration 100 has a game server 101 that communicates with a plurality of game terminals 102 and 103. The game server 101 performs the game functionality to determine the outcome of a game. In one embodiment, the game server 101 may have a processor 106 that operates a random number generator ("RNG") 107 to perform random selections for a game. The RNG 107 may obtain game indicia, e.g., numbers, characters, symbols, etc., from a database 108. The processor 106 may then utilize the RNG 107 to perform a random selection from the obtained data. Further, the game server 101 may store the random selection in the database 108. The processor 106 may be a specialized processor that performs functionality particular to operating a game of chance and determining outcomes for the game of chance.

In another embodiment, the community game configuration 100 utilizes the processor 106 without the RNG 107. For example, the community game configuration 100 may be utilized to operate a game of skill. The game of skill may be a competition between one player and the processor 106, a competition between multiple players, or a competition between each of multiple players and the processor 106. The game of skill may award and/or deduct points during progression of the game of skill. The processor 106 may be a specialized processor that performs functionality particular to determining such game progression and points associated with particular players.

The game server 101 communicates with the game terminals 102 and 103 to provide the game terminals with the random selections. The game terminal 102 sends audio/video signals to a game cabinet 104. The game cabinet 104 displays various game data, e.g., game graphics, game indicia selection, game score, etc. Such game data may be displayed on a game data display 109. Further, various input data, e.g., game wager, may be displayed via a game input display 111. For example, the game input display 111 may be a touch screen. The data displayed on the game input display 111 may alternatively be inputted via physical keyboard, keypad, cursor navigation device, menu navigation device, etc. Further, the game terminal 103 has a game cabinet 105, a game data display 110, and a game input display 112.

Although two game terminals 102 and 103 are illustrated, only one or more than two game terminals may be utilized. Further, various displays may be utilized as an alternative or in addition to the illustrated displays. For example, a single display may perform the functionality of the game data display 109 and the game input display 111. In addition, various displays such as topper screens, auxiliary screens, etc. may be utilized to display additional data, e.g., game graphics, player profile data, advertisements, etc.

Further, the game server 114 automatically monitors the status of various game participants based on a variety of criteria. For example, the game server 101 monitors data indicative of game success such as score, accuracy, amount wagered, etc. The game server 114 then tabulates such data from a single wagering event or from multiple wagering events into a leaderboard. The leader board is then sent to various users, e.g., back betters. Those users may then select an active participant to follow and place the same wagers.

The leader board display device 114 may be a display screen such a movie screen for many users to view, an integrated computing device display screen, a terminal display screen 109 or 110, etc. The leader board display device 114 may also be operably attached to a game chair apparatus so that back betters can actively monitor the game play activity of the active participant that is being monitored. In one embodiment, the leader board display device 114 is utilized for monitoring such game play whereas an additional device such as a game terminal 102 or 103 is utilized to perform game play. In another embodiment, the leader board display device 114 either has game play capabilities or is in operable communication with a device that has game play capabilities. For example, the leader board display device 114 may be attached to a game chair apparatus that has game play functionality. The leader board display device 114 may receive user inputs and send those user inputs to the game chair apparatus for game play. As a result, the same game chair apparatus at which the active participant is playing a game can also be utilized to place wagers by a back better.

A computing device may be a personal computer ("PC"), laptop computer, tablet device, smartphone, etc. The leader board display device 114 may also display notifications such as alerts based upon user defined or game server defined criteria. For example, a user may have a list of active participants that the user is following for possible back betting. A leader board display device 114 such as a smartphone may be utilized to display information associated with those active participants such as current games, player statistics, etc. Notifications indicating changes to the status and/or statistics of those active participants may then be sent to the smartphone of the user so that the user has enough information to back bet.

In one embodiment, the game server 101 generates the leader board. In another embodiment, the game server 101 sends the leader board data to one or more ranking servers that rank the leader board data. For example, a first ranking server may be present in a first location in a casino that has multiple viewers that have a first set of ranking criteria whereas a second ranking server may be present in a second location in a casino that has multiple viewers that have a second set of ranking criteria. For instance, the ranking criteria may be determined based upon votes received at the different locations.

The leader board display device 114 may also display tables corresponding to the game play of the active participants. For example, back bettors can follow real or virtual depictions of particular tables based upon a selection of a particular active participant. The back bettors can then follow the game play of the active participant. In other words, the back bettors can select a particular table to view based upon criteria for the leader board rather than viewing an entire set of tables. The leader board display device 114 may also provide the data itself of the game play of the active participant rather than a real or virtual depiction of the table at which the active participant is located.

Further, the community game configuration 100 may include a network switch 113 that connects the game server 101 to the game terminals 102 and 103 via a network such a local area network ("LAN"), the Internet, etc. The network switch 113 sends data to a game terminal only as required by that particular game terminal. In other words, the network switch 113 does not send data associated with a game being played at the game terminal 102 also to the game terminal 103. Alternatively, various other types of network devices may be utilized instead of or in addition to the network switch 113 to send data. For example, a network hub that broadcasts data may be utilized for games that require the same data to be displayed on a plurality of game terminals.

The community game configuration 100 allows a back bettor to simultaneously follow multiple active participants. Therefore, the community game configuration 100 improves the functionality of previous computing configurations that were limited in providing data to back betters.

Figure 2:
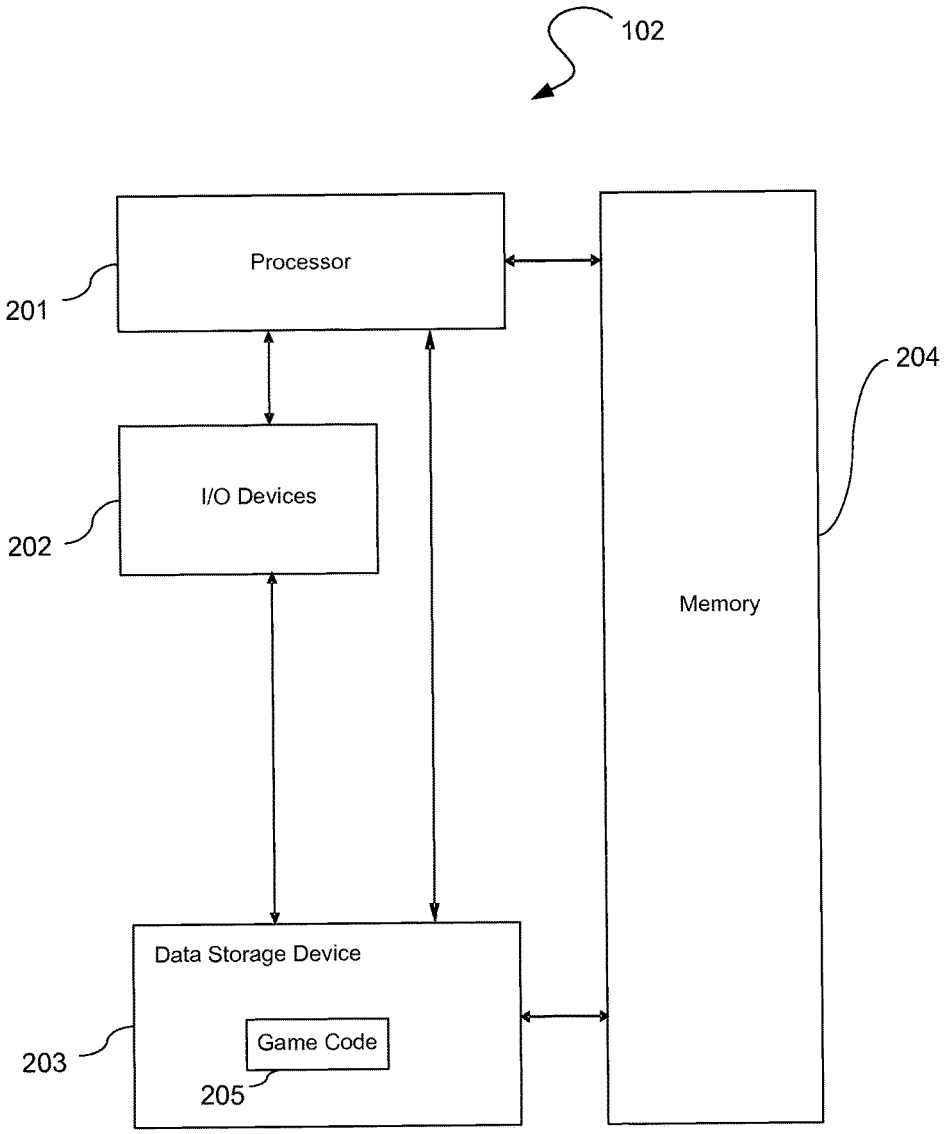
FIG. 2 illustrates the internal components of the game terminal illustrated in FIG. 1.

FIG. 2 illustrates the internal components of the game terminal 102 illustrated in FIG. 1. The game terminal 102 includes a processor 201, input/output ("I/O") devices 202, a data storage device 203, and a memory 204. The data storage device 203 may store game code 205 for implementing the game of chance at the game terminal 102.

Figure 3:
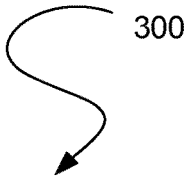
FIG. 3 illustrates an example of a leader board displayed by the leader board display device.

FIG. 3 illustrates an example of a leader board 300 displayed by the leader board display device 114. The leader board 300 includes a listing of various game players that are considered leaders. Various criteria such as score, accuracy, and amount wagered are listed so that a back better may select a leader to follow based upon the criteria of the back better.

Figure 4:
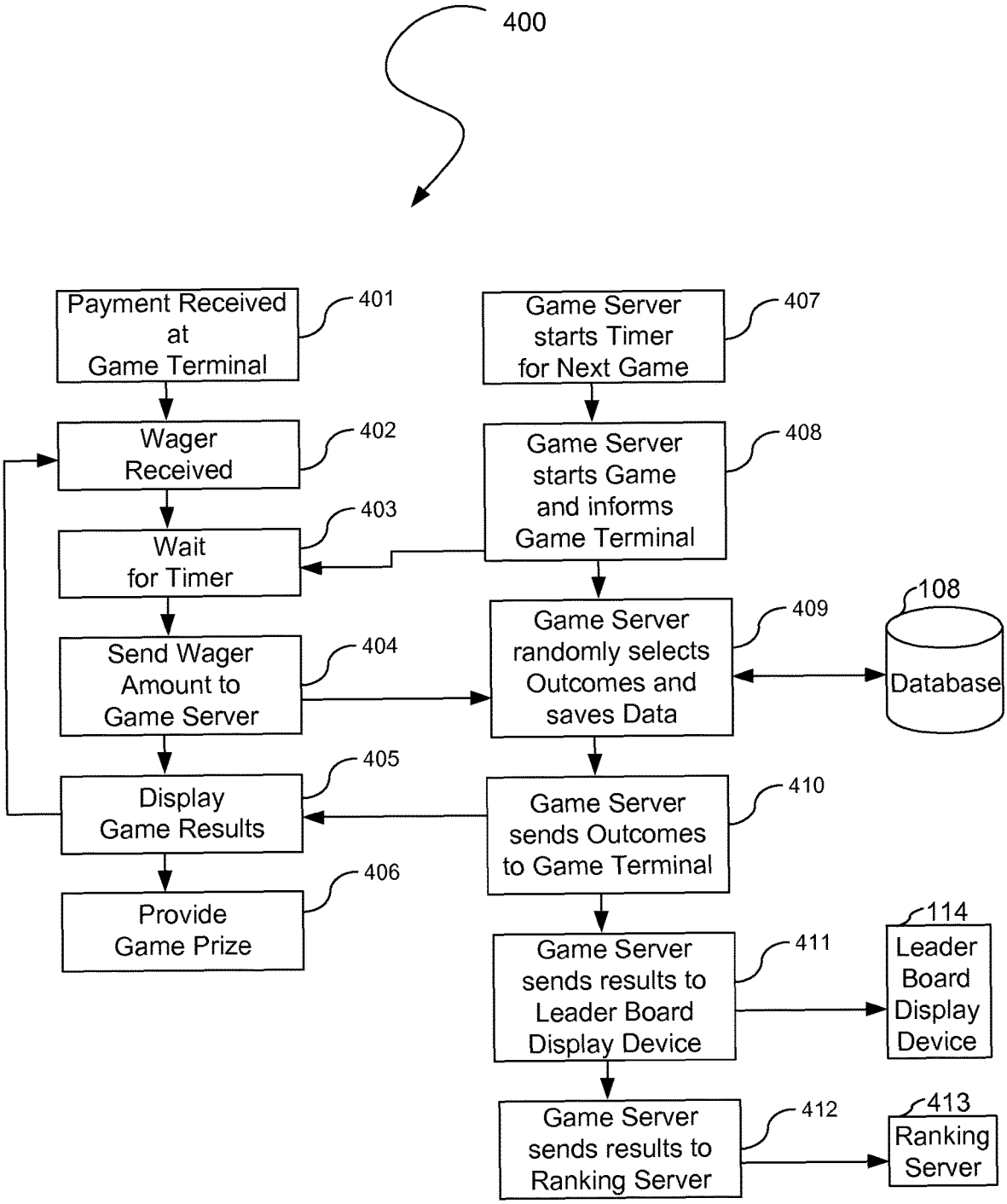
FIG. 4 illustrates a process that is utilized by the game server illustrated in FIG. 1.

FIG. 4 illustrates a process 400 that is utilized by the game server 101 illustrated in FIG. 1. At a process block 401, payment for a wagering event is received at the game terminal 102 or 103 illustrated in FIG. 1. Further, at a process block 402, a wager is selected at the game terminal 102 or 103. At a process block 407, the game server 101 started a timer. Further, at a process block 408, the game server 101 starts a game and informs the game terminal 102 or 103. At a process block 403, the game terminal 102 or 103 waits for the time to run out. Further, at a process block 404, the game terminal 102 or 103 sends the wager amount to the game server 101. At a process block 409, the game server 101 randomly selects an outcome and saves the outcome in the database 108. Further, at a process block 410, the game server 101 sends the outcome to the game terminal 102 or 103 to display the game results. In addition, at a process block 406, the game prize is provided to the player. At a process block 411, the game server 101 sends an outcome to a leader board display device 114. Further, at a process block 412, the game server 101 sends the results to a ranking server 413.

Figure 5:
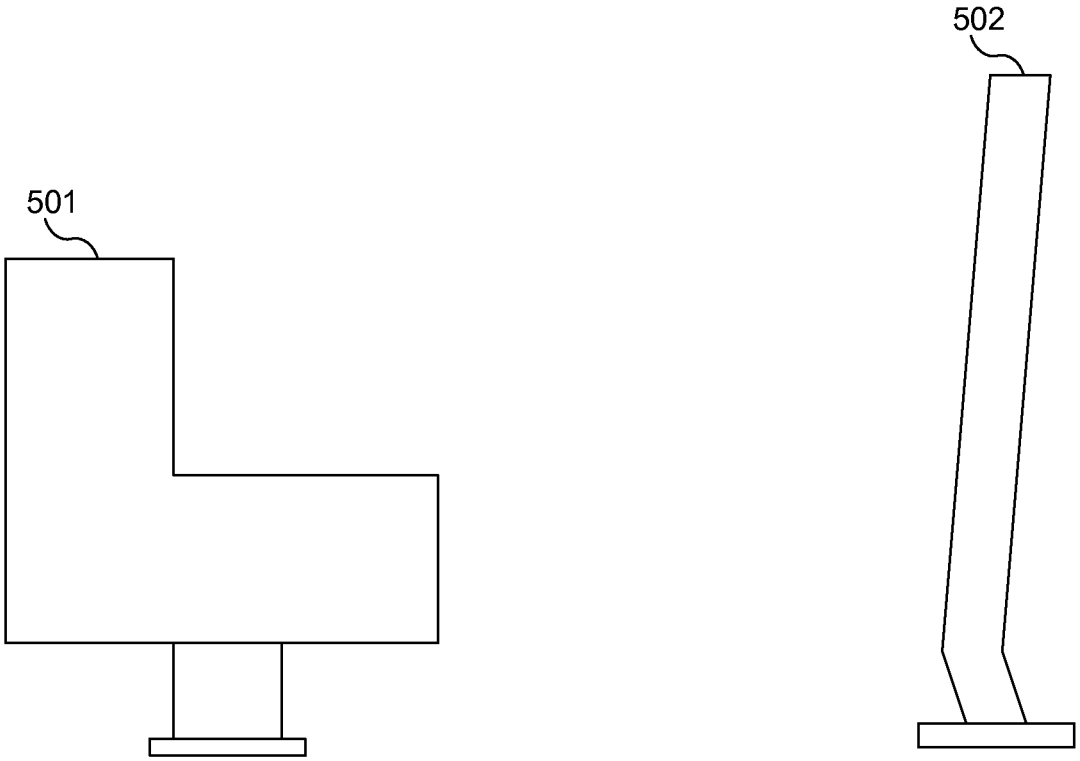
FIG. 5 illustrates a side view of a seating apparatus configuration that is situated in proximity to a display screen.

FIG. 5 illustrates a side view of a seating apparatus configuration 501 that is situated in proximity to a display screen 502. An example of the seating apparatus configuration 501 is a gaming chair that has functionality built into the gaming chair for operation of a game of chance. The player selects and operates a game of chance from the seating apparatus 501, but views the game of chance at a display screen 502 that is distinct from the seating apparatus 501 or is operably connected to the seating apparatus 501. The display screen 502 is in operable communication with the seating apparatus 501, e.g., wired or wireless communication. In an aspect of the disclosure, the display screen 502 may be a touch screen. The display screen 502 may be utilized to display data corresponding to the game of chance for the player situated at the seating apparatus 501. The display screen 502 may also be utilized to display advertisements. The advertisements may be adjusted to correspond to a particular game of chance. Accordingly, the advertisement may appear as a portion of the game of chance. The display screen 502 may also be utilized to display advertisements that do not correspond to the game of chance. The seating apparatus 501 may also be utilized to display advertisements that correspond to the game of chance or other types of advertisements that do not correspond to the game of chance. Other components, e.g., audio components for the display screen 501, may also be enclosed within the cabinet. A locking device may be utilized to prevent access to the cabinet. In one implementation, the high voltage components that are utilized to operate the seating apparatus 100 are stored in the cabinet in proximity to the display screen 502. As a result, the player is not sitting in proximity to high voltage electronic components. Therefore, the cabinet provides for a safer seating apparatus 501 than having the high voltage electronic components in proximity to the player.

The cabinet may store the operational components of the seating apparatus 501 that allow a player to select a game of chance from a plurality of games of chance. For instance, the cabinet may store a processor that selects and operates games of chance, a data storage device that stores games of chance, etc. For example, the processor or processors may be situated on a board or on a plurality of boards stored in the cabinet. As an example, the plurality of boards may be communication boards that communicate with a back end system, e.g., a board that communicates with a player tracking system, a board that communicates with a slot accounting system, a board that communicates with an accounting wagering system, a board that communicates with a ticket in and ticket out system, and/or any other communication board that may be utilized to interface with a network on a casino gaming floor. The processor or processors may be utilized to also provide for payment and player game tracking. For example, the processor or processors may operate payment mechanisms integrated into the seating apparatus 501 to accept payment for game play and may award or redeem player points for game play. The processor or processors may also be utilized to perform facial recognition functionality to recognize the player. For instance, a camera that is operably attached to the seating apparatus 501 may perform an image capture of the player prior to or during game play at the seating apparatus 501. The processor or processors may then compare the image with a plurality of images stored in a local database stored in a storage device located within the seating apparatus 501 or in a remote database to which the processor or processors are in operable communication. After identifying the player from the database, the processor or processors may then customize game play for that particular player, provide particular promotions for that particular player, tabulate game points for that particular player, favorite games, return on play, etc. As an example, the seating apparatus 501 may recognize a player and automatically display a menu of the player's favorite games. Alternatively, the camera may be operably attached to the display screen 502. The player may also have previously provided an input for a particular look and feel for different games. Those configurations may automatically be displayed to the player after the seating apparatus 501 recognizes the player.

Figure 6:
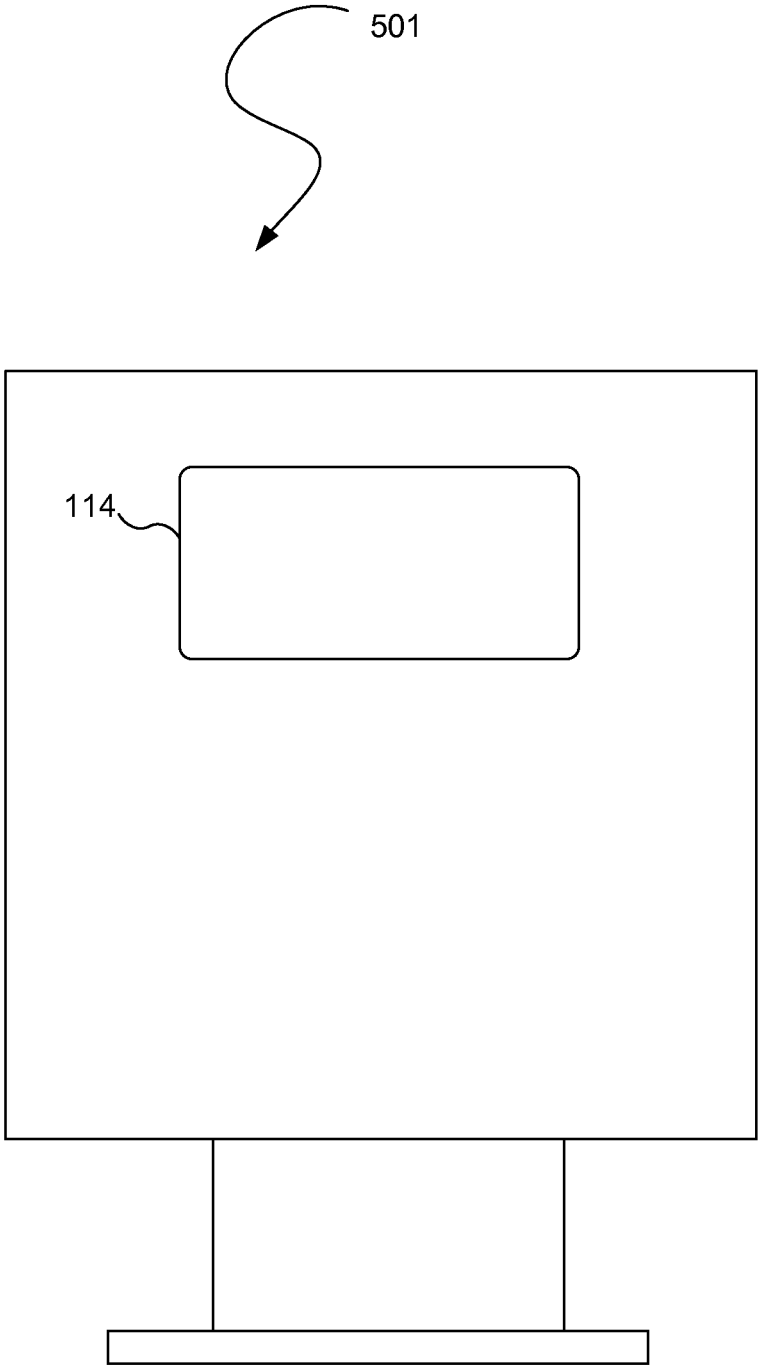
FIG. 6 illustrates a back view of the seating apparatus illustrated in FIG. 5.

FIG. 6 illustrates a back view of the seating apparatus 501 illustrated in FIG. 5. The leader board display device 114 illustrated in FIG. 1 may be positioned on the back of the seating apparatus 501. As a result, back bettors may view a leader board on the back of a seating apparatus 501 at which an active participant is playing a game of chance. The back bettors may view leader board data from the leader board display device 114 to determine if the back bettors want to participate in the game of chance that is being played by the active participant at that seating apparatus 501 or another seating apparatus 501. For example, the leader board display device 114 may display location data, e.g., game chair indicia, for locating an active participant that the back bettor selects to follow. For example, an avatar for a player or game chair may be utilized as game chair indicia. Other game chair indicia such as numbers, characters, symbols, colors, etc. may also be utilized.

Further, a flashing marker may be utilized at the game chair so that a player is allowed to place a wager at the game chair that is similar to that of the active participant at that game chair. The flashing marker may be selected at the leader board display device 114 or other display device that is operably attached or in communication with the seating apparatus 501 and that can receive a user input from a back bettor.

Figure 7:
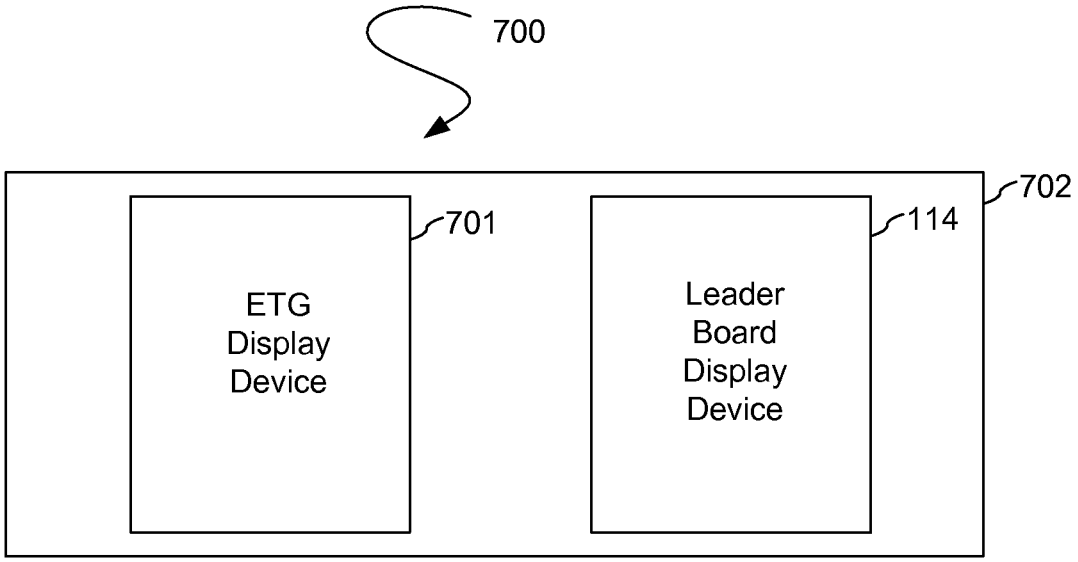
FIG. 7 illustrates a theater community game configuration 700.
Figure 7:
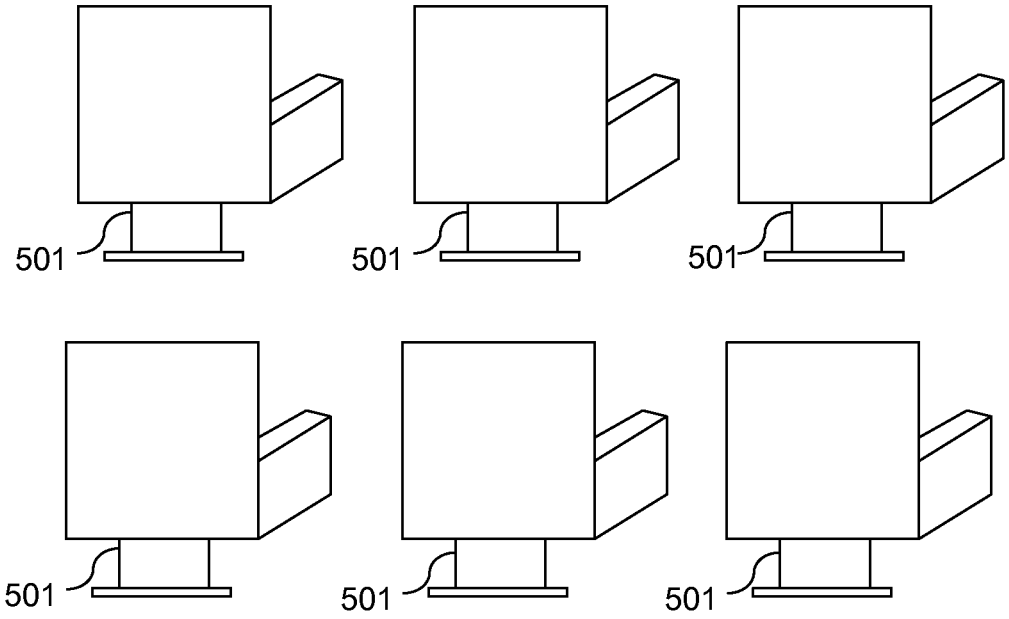

The community game server configuration 100 illustrated in FIG. 1 allows for a variety of different display configurations. For example, the leader board device 114 may be a display screen that is located in a theater for multiple viewers. FIG. 7 illustrates a theater community game configuration 700. The theater community game configuration 700 has a theater type environment. For example, one or more display devices may be placed on a wall 702, a display device stand, etc. Further, one or more seating apparatuses 501 may be positioned in proximity to the one or more display devices.

A game such as an Electronic Table Game ("ETG") may be played in the theater community game configuration 700. The ETG may be deployed with a live dealer, e.g., a Baccarat dealer, or a mechanical device, e.g., a mechanical roulette table, which provides outcomes for which players may place a wager.

An ETG display device 701 displays the game being played in a manner so that players situated at the one or more seating apparatuses 501 are able to view the game in a theater type environment. For example, the roulette table of one or more baccarat tables may be displayed at the ETG display device 701.

Further, the leader board display device 114 may be placed on the wall 702 so that one or more back bettors situated at the one or more seating apparatuses 501 may view the leader board in addition to the ETG display device 701.

Although different display devices are illustrated, a single display device may be utilized to display the ETG and leader board. Further, more than one display device may be utilized to display one or more ETGs and leader boards.

Further, the community game server configuration 100 allows for account wagering for back betting. A player card or an identifier of a seating apparatus 501 may be utilized to track the game play of the back bettor.

It is understood that the apparatuses, processes, and systems described herein may also be applied in other types of apparatuses, processes, and systems. Those skilled in the art will appreciate that the various adaptations and modifications of the embodiments of the apparatuses, processes, and systems described herein may be configured without departing from the scope and spirit of the present apparatuses, processes, and systems. Therefore, it is to be understood that, within the scope of the appended claims, the present apparatuses, processes, and systems may be practiced other than as specifically described herein.

We claim:

1. An apparatus comprising:

a random number generator that randomly selects a set of game indicia for a game of chance;

a database that stores the set of game indicia;

a processor that retrieves the set of game indicia from the database, sends the set of game indicia to a plurality of game terminals to determine an outcome of the game of chance played by a plurality of first players, receives game data from the game terminals based on the outcome, generates leader board data based upon the game data, sends the leader board data for display on multiple displays, and receives a subsequent wager from a plurality of second players using input devices separate from the game terminals, wherein the processor is configured to operate payment mechanisms to accept payment for game play and award or redeem player points for game play;

a plurality of game chairs coupled to the random number generator, the database, and the processor, each game chair configured to allow the plurality of first players to play the game of chance using the game terminals, wherein one or more game chairs in the plurality of game chairs includes a camera for performing image capture and facial recognition of a player, wherein facial recognition includes capturing an image of the player and then comparing the image with a plurality of images stored on a local or remote database to which the processor is in operable communication, wherein the processor is further configured to, after identifying the player, customize game play for that particular player, provide particular promotions for that particular player, tabulate game points for that particular player, and automatically display a menu of that particular player's favorite games; and a plurality of leader board display devices coupled to the plurality of game chairs, wherein each leader board display device includes an input device for back betting and is positioned at the rear of a game chair in the plurality of game chairs such that a second player in the plurality of second players can actively participate in the game of chance with a first player in the plurality of first players via back betting using a leader board display device positioned at the rear of a game chair, wherein the leader board displays are configured to display a flashing marker to allow a second player to place a wager at a game chair that is similar to an active first player seated at the game chair, wherein the plurality of game chairs and the plurality of leader board display devices are operably connected to one another in a community gaming configuration such that a second player in the plurality of second players can place a back bet on any first player in plurality of first players using just a single leader board display device on the back of a game chair, wherein the leader board display devices are further configured to display location data such as game chair indicia for active seated participants in order for the second players to choose which active seated participants to follow.

2. The apparatus of claim 1, wherein the processor sends the leader board data to leader board display device.

3. The apparatus of claim 2, wherein the leader board display device is a computing device.

4. The apparatus of claim 3, wherein the processor sends a notification to the leader board display device based upon a change to the game data.

5. The apparatus of claim 3, wherein the leader board display device is operably connected to a game chair apparatus.

6. The apparatus of claim 3, wherein the leader board display device receives a wager for game play of a game of chance based on back betting.

7. The apparatus of claim 3, wherein the leader board display device displays a table at which the game of chance is being played by the seated player.

8. The apparatus of claim 3, wherein the leader board data is ranked according to a set of criteria.

9. The apparatus of claim 1, wherein the processor receives additional game data from additional game terminals.

10. The apparatus of claim 8, wherein the leader board data is also based on the additional game data.

11. An apparatus comprising:

an input device that receives, from a first player, selection of a game of chance for game play and a wager amount;

a processor that sends the wager amount to a game server, receives a randomly selected outcome from the game server, and receives leader board data based upon the game data, wherein the processor is configured to operate payment mechanisms to accept payment for game play and award or redeem player points for game play;

a game chair apparatus in operable communication with the input device and the processor, wherein the game chair includes a camera for performing image capture and facial recognition of a player, wherein facial recognition includes capturing an image of the player and then comparing the image with a plurality of images stored on a local or remote database to which the processor is in operable communication, wherein the processor is further configured to, after identifying the player, customize game play for that particular player, provide particular promotions for that particular player, tabulate game points for that particular player, and automatically display a menu of that particular player's favorite games; and a leader board display device having game functionality that displays the leader board data and receives an input indicating a subsequent wager from a second player for a subsequent game of chance for the second player to perform back betting, the leader board display device being positioned at the rear of the game chair apparatus, wherein the leader board display is configured to display a flashing marker to allow the second player to place a wager at the game chair that is similar to the first player seated at the game chair, wherein the game chair apparatus and the leader board display device is operably connected to other game chair apparatuses and other leader board display devices in a community gaming configuration such that the second player can place a back bet on the first player or any other player in the community gaming configuration using just the leader board display device, wherein the leader board display device is further configured to display location data such as game chair indicia for active seated participants in a plurality of other game chair apparatuses in order for the second player to choose which active seated participants to follow.

12. The apparatus of claim 11, wherein the back betting is performed at an addition apparatus that is distinct from the apparatus.

13. The apparatus of claim 11, wherein the back betting is performed at the apparatus.

14. The apparatus of claim 13, wherein the processor sends the leader board data to a leader board display device in operable communication with the apparatus.

15. The apparatus of claim 14, wherein the leader board display device is a computing device.

16. The apparatus of claim 15, wherein the processor sends a notification to the leader board display device based upon a change to the game data.

17. The apparatus of claim 15, wherein the leader board display device is operably connected to a game chair apparatus.

18. The apparatus of claim 15, wherein the leader board display device receives a wager for game play of a game of chance based on back betting.

19. The apparatus of claim 15, wherein the leader board display device displays a table at which the game of chance is being played by the first player.

20. An apparatus comprising:

an input device that receives, from a first player, selection of a game of skill for game play and a wager amount;

a processor that sends the wager amount to a game server, receives a randomly selected outcome from the game server, and receives leader board data based upon the game data, wherein the processor is configured to operate payment mechanisms to accept payment for game play and award or redeem player points for game play;

a game chair apparatus in operable communication with the input device and the processor, wherein the game chair includes a camera for performing image capture and facial recognition of a player, wherein facial recognition includes capturing an image of the player and then comparing the image with a plurality of images stored on a local or remote database to which the processor is in operable communication, wherein the processor is further configured to, after identifying the player, customize game play for that particular player, provide particular promotions for that particular player, tabulate game points for that particular player, and automatically display a menu of that particular player's favorite games; and a leader board display device having game functionality that displays the leader board data, receives an input indicating a subsequent wager from a second player for a subsequent game of chance for the second player to perform back betting, and receives a second input for operation of the game of skill, the leader board display device being positioned at the rear of the game chair apparatus, wherein the leader board display is configured to display a flashing marker to allow the second player to place a wager at the game chair that is similar to the first player seated at the game chair, wherein the game chair apparatus and the leader board display device is operably connected to other game chair apparatuses and other leader board display devices in a community gaming configuration such that the second player can place a back bet on the first player or any other player in the community gaming configuration using just the leader board display device, wherein the leader board display device is further configured to display location data such as game chair indicia for active seated participants in a plurality of other game chair apparatuses in order for the second player to choose which active seated participants to follow.

* * * * *